US007427998B2

(12) United States Patent
Yokoyama

(10) Patent No.: US 7,427,998 B2
(45) Date of Patent: Sep. 23, 2008

(54) THERMAL HEAD HAVING BENT ELECTRODE STRUCTURE AND METHOD OF MANUFACTURING THE SAME

(75) Inventor: Shinya Yokoyama, Niigata-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/850,521

(22) Filed: Sep. 5, 2007

(65) Prior Publication Data

US 2008/0062239 A1 Mar. 13, 2008

(30) Foreign Application Priority Data

Sep. 12, 2006 (JP) ..... 2006-246240

(51) Int. Cl.
*B41J 2/335* (2006.01)

(52) U.S. Cl. ..... 347/202

(58) Field of Classification Search ..... 347/200, 347/202, 203, 204, 205, 206, 207, 208
See application file for complete search history.

(56) References Cited

U.S. PATENT DOCUMENTS

2007/0229645 A1* 10/2007 Yamamoto et al. ..... 347/202

FOREIGN PATENT DOCUMENTS

JP 7-12696 2/1995

* cited by examiner

*Primary Examiner*—K. Feggins
(74) *Attorney, Agent, or Firm*—Brinks Hofer Gilson & Lione

(57) ABSTRACT

A thermal head having electrode wiring lines in a narrow wiring region, in which a line and a space are narrow, with good pattern accuracy and a method of manufacturing the same are provided. A thermal head includes: a plurality of heating resistors arranged in a line at predetermined pitches there between on a protruding level difference part of a glazed substrate; bent wiring lines each of which serves to electrically connect a pair of adjacent heating resistors to each other; a common wiring line and individual wiring lines used to cause the pair of adjacent heating resistors to be electrically conducted through each of the bent wiring lines; and bonding pads formed on one ends of the individual wiring lines. The common wiring line has a narrow wiring region located between the bonding pads arranged in a line and a wide wiring region wider than the narrow wiring region. The wide wiring region is formed using a conductor layer and a resistor layer made of the same material as the heating resistors, and the narrow wiring region is formed using only the conductor layer without the resistor layer.

4 Claims, 8 Drawing Sheets

THERMAL HEAD HAVING BENT ELECTRODE STRUCTURE AND METHOD OF MANUFACTURING THE SAME

This application claims the benefit of Japanese Patent Application No. 2006-246240 filed Sep. 12, 2006, which is hereby incorporated by reference.

BACKGROUND

1. Field of the Invention

The present invention relates to a thermal head having a bent electrode structure and a method of manufacturing the same.

2. Description of the Related Art

A known thermal head usually comprises a bent electrode structure, a common wiring line and an individual wiring line. The bent electrode structure includes where a bent electrode, which serves to electrically connect a pair of adjacent heating resistors to each other. The common wiring line and an individual wiring line are used to cause the pair of heating resistors to be electrically conducted through each of the bent wiring lines. The electrode structure causes a plurality of heating resistors, which are arranged at predetermined pitches there between on a glazed substrate, to electrically conduct. Electrode wiring lines in the bent electrode structure are becoming finer as the density increases and substrates become smaller. Particularly in the case of a common wiring line located between bonding pads of individual wiring lines, a line and a corresponding space (electrode width and a gap between electrodes) are very narrow, that is, currently about 12 μm and 6 μm, respectively, since it is difficult to make the bonding pads for driver ICs formed at one ends of the individual wiring lines small more than a predetermined amount.

When a protruding level difference glazed substrate having a protruding level difference part is used as a glazed substrate, the electrode wiring lines (bent electrodes, common wiring line, and individual wiring lines) are obtained by forming a resistor layer on the entire surface of the protruding level difference glazed substrate, forming the resistor layer as a resistor pattern having a predetermined shape using a photolithographic method, and then forming a conductor layer on the resistor pattern excluding a region where a plurality of heating resistors on the protruding level difference part are formed. Specifically, when a photolithographic process is used for forming a resistor pattern, a resist is coated on a resistor layer, the resist is exposed and developed to form a resist pattern for obtaining a predetermined resistor shape. The resistor layer is etched using the resist pattern as a mask, and the resist is removed. When forming the resist pattern, the entire resist is exposed in a state in which an exposure focus is focused on a top portion of the protruding level difference part in order to define the planar size of the heating resistors with high accuracy (one-shot exposure: see FIG. 5). The conductor layer is formed using the photolithographic method (resist coating, exposure, development, etching, resist removal) in which some resistor patterns formed at top and bottom portions of the protruding level difference part are used as upper and lower alignment marks (positioning indicators). The resistor pattern located directly below the conductor layer serves as an adhesive layer for improving the adhesion between the conductor layer and the glazed substrate.

In recent years, as the density increases and a substrate become smaller, a level difference of the protruding level difference part of the protruding level difference glazed substrate tends to increase. For this reason, when forming the electrode wiring lines, an exposure focus at the bottom portion of the protruding level difference part is not clear in a one-shot exposure (in which the entire resist is exposed in a state where an exposure focus is focused on the top portion of the protruding level difference part). As a result, the patterning accuracy is lowered. It is desirable to secure sufficient line and space for electrode wiring lines. However, it has been difficult to form a fine electrode wiring line in a narrow wiring region where a fine electrode wiring line, such as the common wiring line located between the bonding pads, is needed. For example, the electrodes have been short-circuited because the conductor layer or the resistor layer between electrodes is not completely removed. As a measure to solve this problem, a two-step exposure has been considered. Here an exposure focus is focused on each of the top and bottom portions of the protruding level difference part (see FIG. 6) and use a resist pattern of the top portion and a resist pattern of the bottom portion to thereby improve the patterning accuracy.

However, in order to form a conductor layer using the two-step exposure, alignment masks provided at the top and bottom portions respectively of the protruding level difference part are used for alignment with the resistor pattern. The alignment marks need to be simultaneously formed at the top and bottom portions of the protruding level difference part in the same process using a part of the resistor pattern. However, when forming the resistor pattern using the two-step exposure, the alignment marks of the top and bottom portions cannot be formed at the same time. As a result, positional deviation occurs in the alignment marks. Accordingly, in the case where the conductor layer is formed by using the alignment marks as indicators, pattern deviation at the top and bottom portions of the protruding level difference part and pattern deviation with respect to the resistor pattern become too large. This also makes it difficult to obtain fine electrode wiring lines.

SUMMARY

In view of the above, it is an object of the invention to provide a thermal head capable of forming electrode wiring lines in a narrow wiring region, in which a line and a space are narrow, with good pattern accuracy and a method of manufacturing the same.

The invention has been finalized paying attention to the following three points. First, alignment marks can be formed at the same time at top and bottom portions of a protruding level difference part if a resistor pattern is formed by performing one-shot exposure, and a conductor layer can be formed with good pattern accuracy by performing two-step exposure using the alignment marks. Second, if electrode wiring lines of a narrow wiring region are formed using only a conductor layer without providing a resistor layer, fine electrode wiring lines can be formed in the narrow wiring region (wiring lines are not short-circuited) even if the resistor pattern is formed by the one-shot exposure. Third, if electrode wiring lines are formed using the resistor layer and the conductor layer in a region other than the narrow wiring region 8A, the adhesion of the electrode wiring lines (conductor layer) is improved.

That is, according to an aspect of the invention, there is provided a thermal head including: a glazed substrate having a protruding level difference part; a plurality of heating resistors arranged in a line at predetermined pitches there between on the protruding level difference part; and electrode wiring lines used to cause the plurality of heating resistors to electrically conduct. Each of the electrode wiring lines has a wide wiring region and a narrow wiring region. The wide wiring region is formed using a conductor layer and a resistor layer made of the same material as the heating resistors. The narrow wiring region is formed using only the conductor layer without providing the resistor layer.

Further, according to another aspect of the invention, there is provided a thermal head including: a glazed substrate having a protruding level difference part; a plurality of heating resistors arranged in a line at predetermined pitches there between on the protruding level difference part;

bent wiring lines each of which serves to electrically connect a pair of adjacent heating resistors to each other; a common wiring line and individual wiring lines used to cause the pair of adjacent heating resistors to electrically conduct through each of the bent wiring lines; and bonding pads used for connection of a driver IC, the bonding pads being formed on one ends of the individual wiring lines. The common wiring line has a narrow wiring region located between the bonding pads arranged in a line and a wide wiring region wider than the narrow wiring region. The wide wiring region is formed using a conductor layer and a resistor layer made of the same material as the heating resistors. The narrow wiring region is formed using only the conductor layer without the resistor layer.

In addition, according to still another aspect of the invention, a method of manufacturing a thermal head includes: forming a resistor layer on an entire surface of a glazed substrate having a protruding level difference part; patterning the resistor layer at the same time at top and bottom portions of the protruding level difference part such that a plurality of heating resistors, a resistor pattern that is removed in a narrow wiring region where the width of an electrode wiring line to be formed is small and that exists in a wide wiring region wider than the narrow wiring region, upper and lower alignment marks indicating top and bottom portions of the protruding level difference part are formed; forming a conductor layer on the entire surface of the glazed substrate including the resistor pattern; coating a resist on the conductor layer; performing positional alignment of a photomask using the upper alignment mark and exposing the resist at the top portion in a state in which an exposure focus is focused on the top portion of the protruding level difference part; performing positional alignment of a photomask using the lower alignment mark and exposing the resist at the bottom portion in a state in which an exposure focus is focused on the bottom portion of the protruding level difference part; developing the resist after the exposure such that a resist pattern having the same shape as electrode wiring lines to be formed is formed; and etching the conductor layer using the resist pattern as a mask and removing the resist pattern after the etching.

DESCRIPTION OF THE EMBODIMENT

Figure 1:
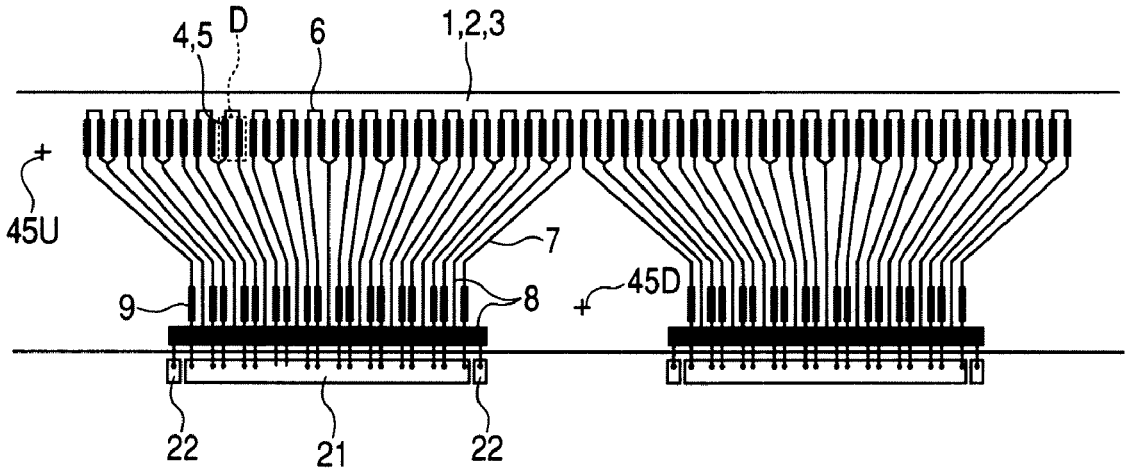
FIG. 1 is a view schematically illustrating the entire configuration of a thermal head according to an embodiment.
Figure 2:
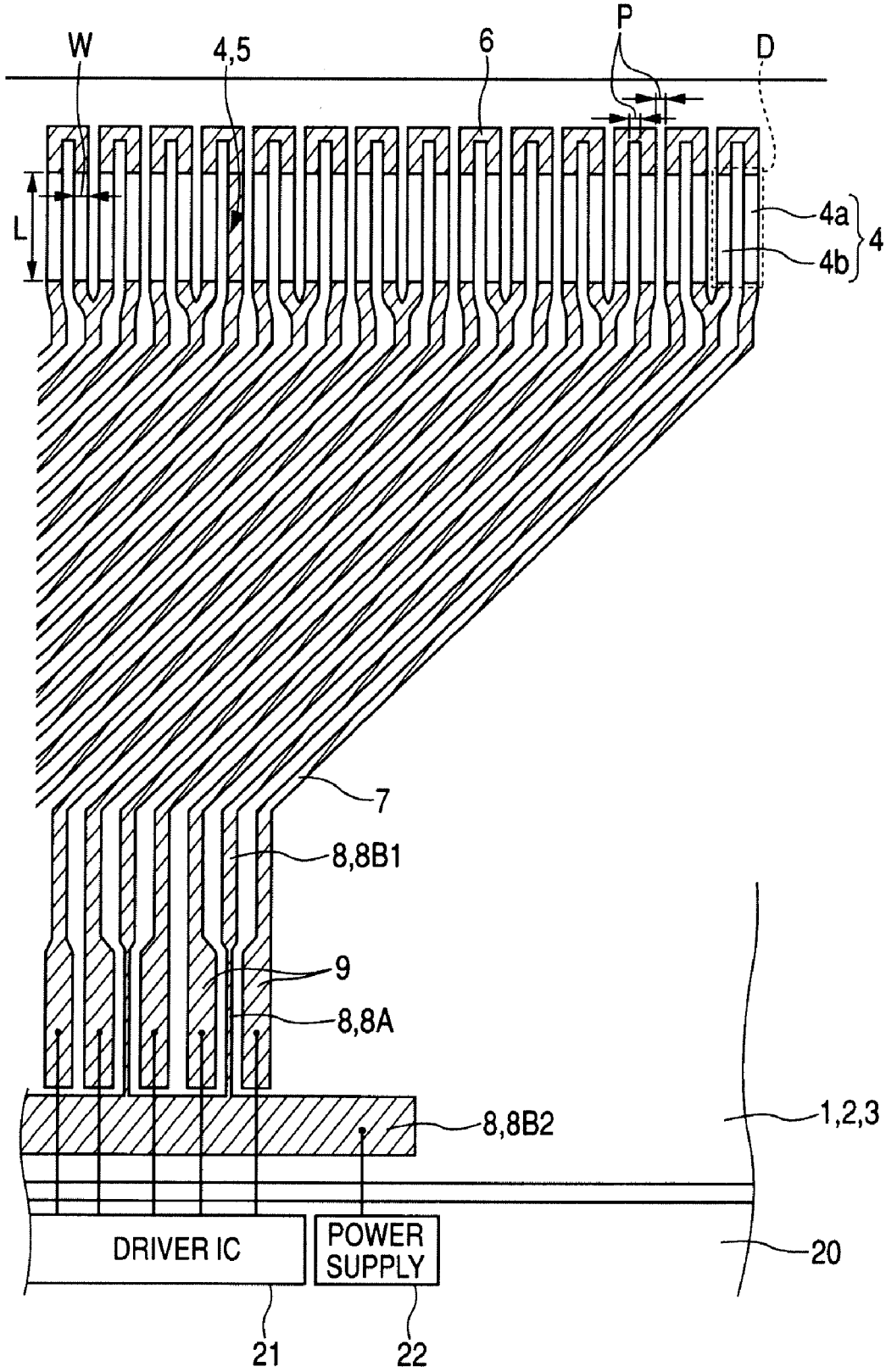
FIG. 2 is an enlarged plan view illustrating a part of the thermal head.
Figure 3:
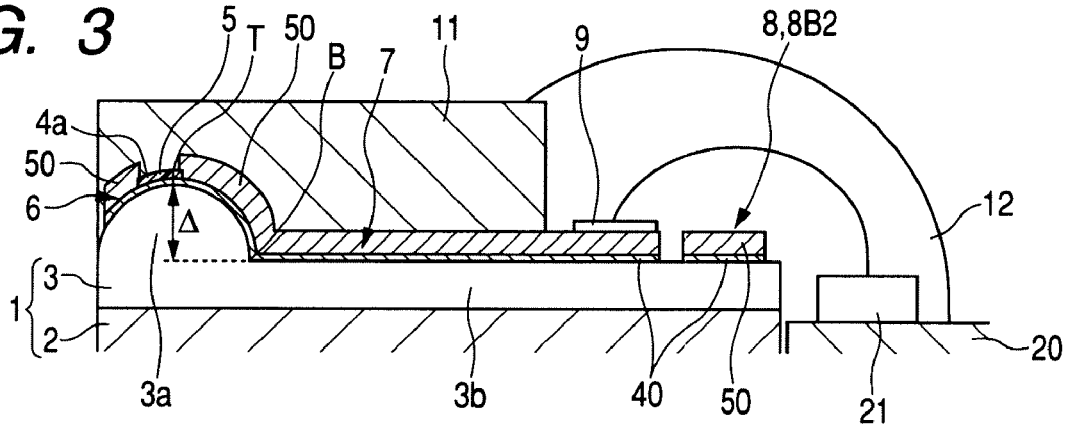
FIG. 3 is a cross-sectional view illustrating a bent wiring line and an individual wiring line of the thermal head.

FIG. 1 is a view schematically illustrating the entire configuration of a thermal head according to an embodiment. FIG. 2 is an enlarged plan view illustrating a part of the thermal head. FIG. 3 is a cross-sectional view illustrating a bent wiring line and an individual wiring line of the thermal head.

A thermal head includes a head substrate 1 having a plurality of heating resistors and an IC substrate 20 used to control electrical conduction of the heating resistors.

The head substrate 1 is a glazed substrate having a glaze layer (entire glaze layer) 3 on a surface of a heating substrate 2 made of Si, a ceramic material, a metal material, and the like. The glaze layer 3 is configured to include: a protruding level difference part 3*a* that is located at an end side of the heating substrate 2 and has an approximately hemispherical cross section. A flat part 3*b* extends from a bottom portion of the protruding level difference part 3*a* and is formed of a uniform thickness. The height of the bottom portion of the protruding level difference part 3*a* and the surface height of the flat part 3*b* are equal to each other. A level difference Δ between a top portion T and a bottom portion B of the protruding level difference part 3*a* is about 50 μm to about 200 μm.

On the protruding level difference part 3*a* of the glaze layer 3, a plurality of heating resistors 4 arranged in a line at predetermined pitch distances P there between are formed in left and right directions of FIGS. 1 and 2. The plurality of heating resistors 4 is a part of a resistor pattern that is locally formed on the glaze layer 3 using Ta2N or Ta—SiO2, for example. Each of the plurality of heating resistors 4 is covered by an insulating barrier layer 5. The resistor pattern is formed not only in a region where the plurality of heating resistors 4 are formed but also as an adhesive layer of an electrode conductor layer in a part of a region in which electrode wiring lines are formed, and as alignment marks 45U and 45D (FIG. 1) for resist patterning in a spare region not overlapping the region where the heating resistors 4 and the electrode wiring layers are formed. The insulating barrier layer 5 is made of an insulating material, such as SiO2, SiON, and SiAlON, and defines a planar size (resistor length L, resistor width W) of each of the heating resistors 4. A gap where the glaze layer 3 is exposed is provided between adjacent heating resistors 4. In the present embodiment, a pair of adjacent heating resistors 4 (4*a* and 4*b*) form one print dot D. A pitch distance P between the heating resistors 4 and between the print dots D is about 5 μm.

As shown in FIG. 2, the two heating resistors 4*a* and 4*b* are connected to each other such that one end of each of the heating resistors 4*a* and 4*b* in the longitudinal direction thereof are connected through a bent wiring line 6.

An individual wiring line 7 is connected to the other end of the heating resistor 4*a* in the longitudinal direction thereof, and a common wiring line 8 is connected to the other end of the heating resistor 4*b* in the longitudinal direction thereof. The individual wiring line 7 and the common wiring line 8 are connected to the pair of heating resistors 4*a* and 4*b* in the same direction, and a gap where the glaze layer 3 is exposed is provided between the individual wiring line 7 and the common wiring line 8. Ends of the bent wiring line 6, the individual wiring line 7, and the common wiring line 8 positioned at the side of the heating resistors 4 are overlaid by the insulating barrier layer 5.

The bent wiring line 6 is formed in a 'U' shape and has a line and a space equal to the resistor width W and the pitch distance P of the heating resistor 4. The bent wiring lines 6 may be formed in a rectangular shape so as to cover the pair of heating resistors 4*a* and 4*b* and the distance there between.

The individual wiring line 7 is an electrode wiring line used to cause each of the plurality of print dots D, each of which is configured to include the pair of heating resistors 4*a* and 4*b*, to electrically conduct and is provided corresponding to each print dot D. Each of the individual wiring lines 7 has a bonding pad 9 for external connection, which is formed at the other end opposite to one end connected to the heating resistor 4*a*. The individual wiring line 7 is connected through the bonding pad 9 to a driver IC 21 on the IC substrate 20. The driver IC 21 performs an electrical conduction control for causing the plurality of print data D to be selectively conducted. The bonding pad 9 is formed to have a width larger than the individual wiring line 7. A gap between the adjacent bonding pads 9 is smaller than the pitch distance P between the heating resistors 4.

The common wiring line 8 is an electrode used to apply a common electric potential to the plurality of print data D. The common wiring line 8 has a narrow wiring region 8A, which is located between the bonding pads 9 and has a narrow width, and a wide wiring region 8B having a larger width than the narrow wiring region 8A.

The wide wiring region 8B includes: a plurality of branch wiring line portions 8B1 respectively connected to the heating resistors 4*b* of the adjacent print data D; and a single large-area wiring line portion 8B2 which extends in the direction (left and right directions of FIGS. 1 and 2) in which the plurality of print dots D are arranged, electric power being supplied from both ends of the large-area wiring line portion 8B2 in the arrangement direction. Each of the plurality of branch wiring line portions 8B1 is formed to have a line and a space equal to the resistor width W and the pitch P of the heating resistor 4. The large-area wiring line portion 8B2 is formed to have a much larger width than the resistor width W of the heating resistor 4 in order to lower the common resistance. Power sources 22 of the IC substrate 20 are connected to both the ends of the large-area wiring line portion 8B2 in the longitudinal direction thereof by wire bonding.

Figure 4A:
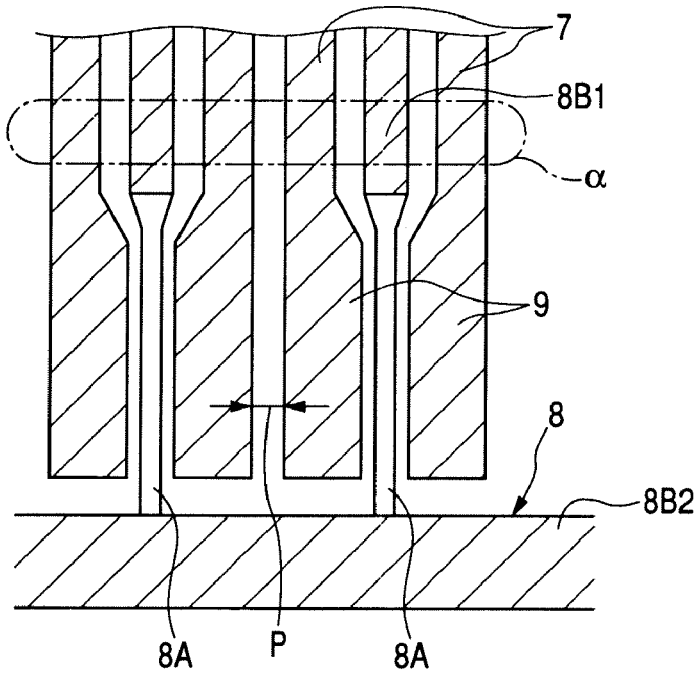
FIG. 4A is an enlarged plan view illustrating a common wiring line of the thermal head.
Figure 4B:
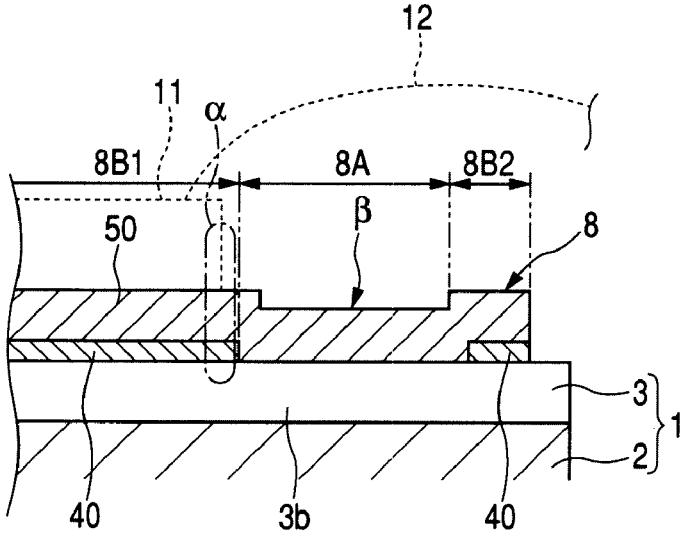
FIG. 4B is a cross-sectional view illustrating a part of the common wiring line.

The narrow wiring region 8A is a narrow wiring portion that is located between the bonding pads 9 in order to connect the plurality of branch wiring line portions 8B1 and the large-area wiring line portion 8B2 with each other. Currently, the case of the narrow wiring region 8A, the line and the space are about 12 μm and 6 μm, respectively. These are much smaller than the branch wiring line portion 8B1 and the large-area wiring line portion 8B2. FIG. 4A is an enlarged plan view illustrating the narrow wiring region 8A, and FIG. 4B is a cross-sectional view illustrating the narrow wiring region 8A.

The substrate surface of the head substrate 1 including the insulating barrier layer 5, the bent wiring lines 6, the individual wiring lines 7, and the common wiring line 8 is covered by an insulating and abrasion-resistant protective layer 11 excluding a bonding portion (the bonding pads 9, the large-area wiring line portion 8B2 of the common wiring line 8, and the narrow wiring region 8A). The insulating and abrasion-resistant protective layer 11 is made of an insulating material, such as SiO2 and SiAlON, and serves to protect the head substrate 1 and the IC substrate 20 against friction due to coming in contact with a platen roller and the like.

The IC substrate 20 is provided adjacent to the head substrate 1. On a surface of the IC substrate 20, a plurality of driver ICs 21 and the pair of power sources 22 arranged with the driver ICs 21 interposed there between are provided. Each of the driver ICs 21 is a switching element that switches supply of power to the heating resistor 4*a* of each print dot D. Although not shown in FIG. 1 for the purpose of easy understanding, each of the driver ICs 21 actually includes control lines corresponding to the number of 128-bit print dots D.

The bonding portions (bonding pads 9, narrow wiring region 8A of the common wiring line 8, and large-area wiring line portion 8B2) of the driver IC 21 of the IC substrate 20, the pair of power sources 22, and the head substrate 1 are sealed with a sealing resin 12.

In the thermal head having the above configuration, the bent wiring lines 6, the individual wiring lines 7, and the wide wiring region 8B of the common wiring line 8 shown in FIG. 3 are formed using a resistor layer 40 and an Al conductor layer 50. The resistor layer 40 located in a region, in which the bent wiring lines 6, the individual wiring lines 7, and the wide wiring region 8B of the common wiring line 8 are formed, is interposed between the Al conductor layer 50 and the glaze layer 3, thereby serving as an adhesive layer for increasing the adhesion of the Al conductor layer 50.

On the other hand, the narrow wiring region 8A of the common wiring line 8 shown in FIGS. 4A and 4B is formed using only the Al conductor layer 50 and does not have the resistor layer 40. Referring to FIG. 4A, a white region indicates a region where the resistor layer 40 does not exist, and a hatched region indicates a region where the resistor layer 40 exists. Using the configuration in which the resistor layer 40 is not provided, fine electrode wiring lines can be formed with high accuracy (resistors are patterned by one-shot exposure (see FIG. 5) and then Al conductors are patterned by two-step exposure (see FIG. 6)). Since the resistor layer 40 does not exist in the narrow wiring region 8A, the adhesion between the glaze layer 3 and the Al conductor layer 50 is weak. However, since the narrow wiring region 8A is covered by the sealing resin 12, the Al conductor layer 50 does not peel off or does not break.

Figure 5:
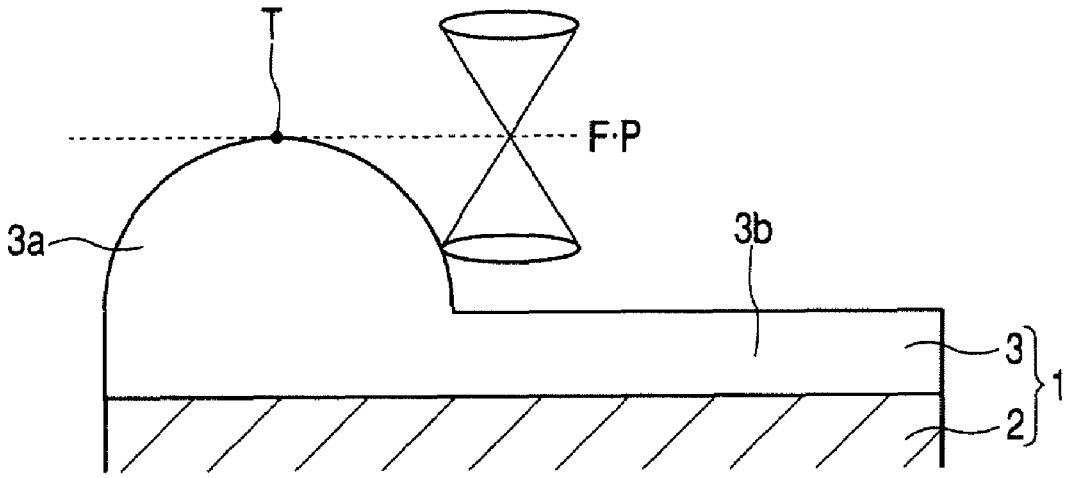
FIG. 5 is a view schematically explaining one-shot exposure of a resist performed in a photolithographic process of a method of manufacturing a thermal head according to another embodiment of the invention.
Figure 6:
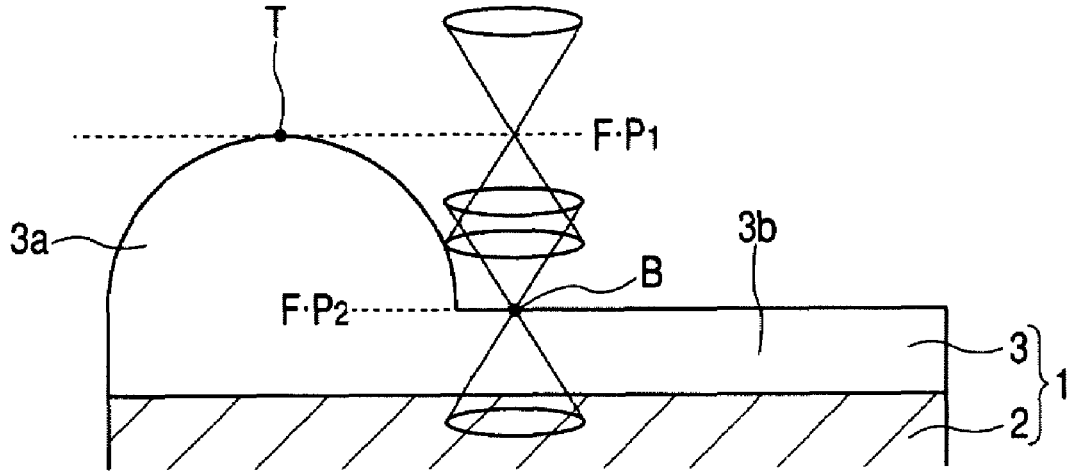
FIG. 6 is a view schematically explaining two-step exposure of a resist performed in the photolithographic process.
Figure 7:
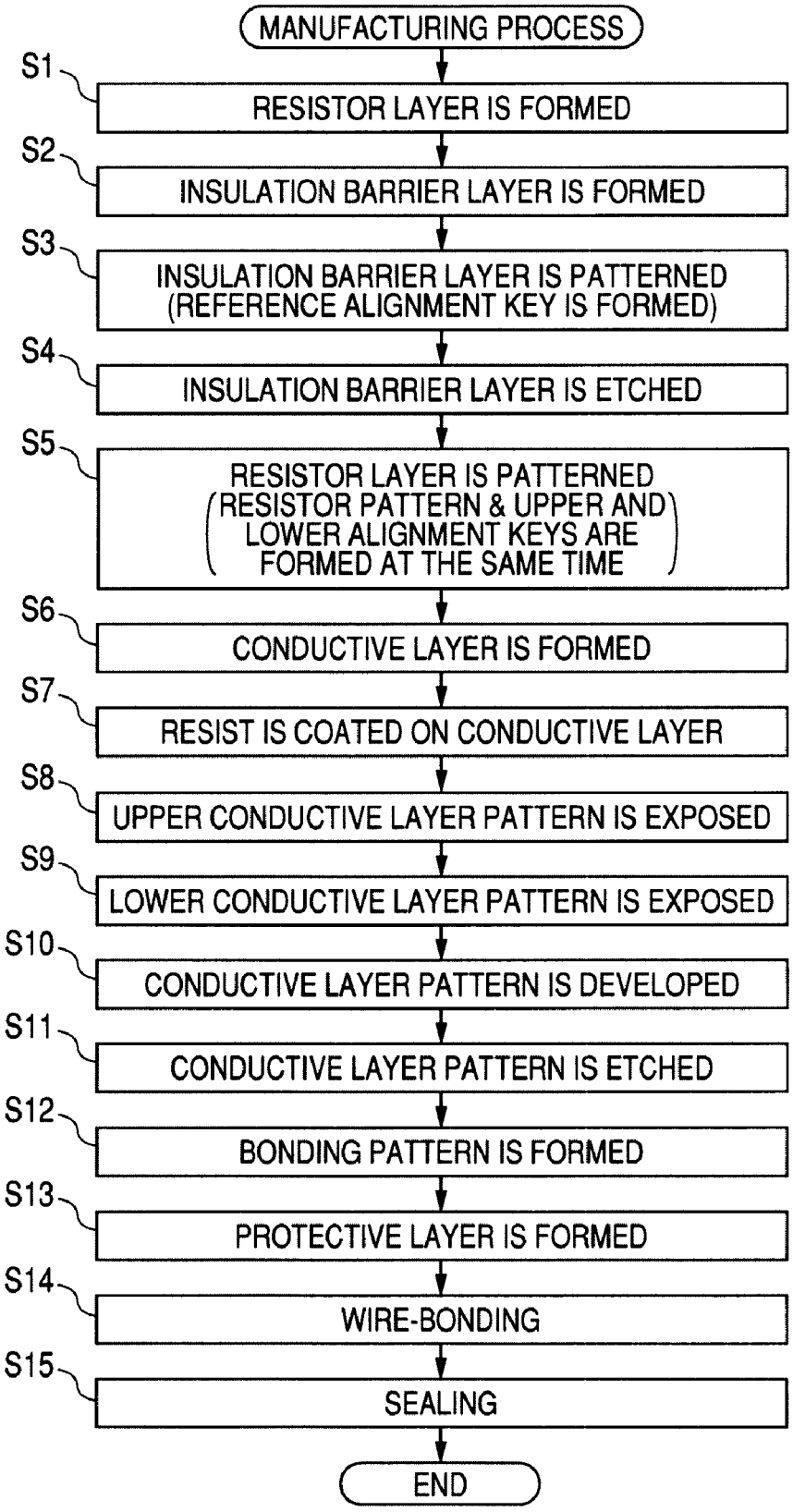
FIG. 7 is a flow chart illustrating the flow of a process of manufacturing the thermal head according to the embodiment of the invention.
Figure 8A:
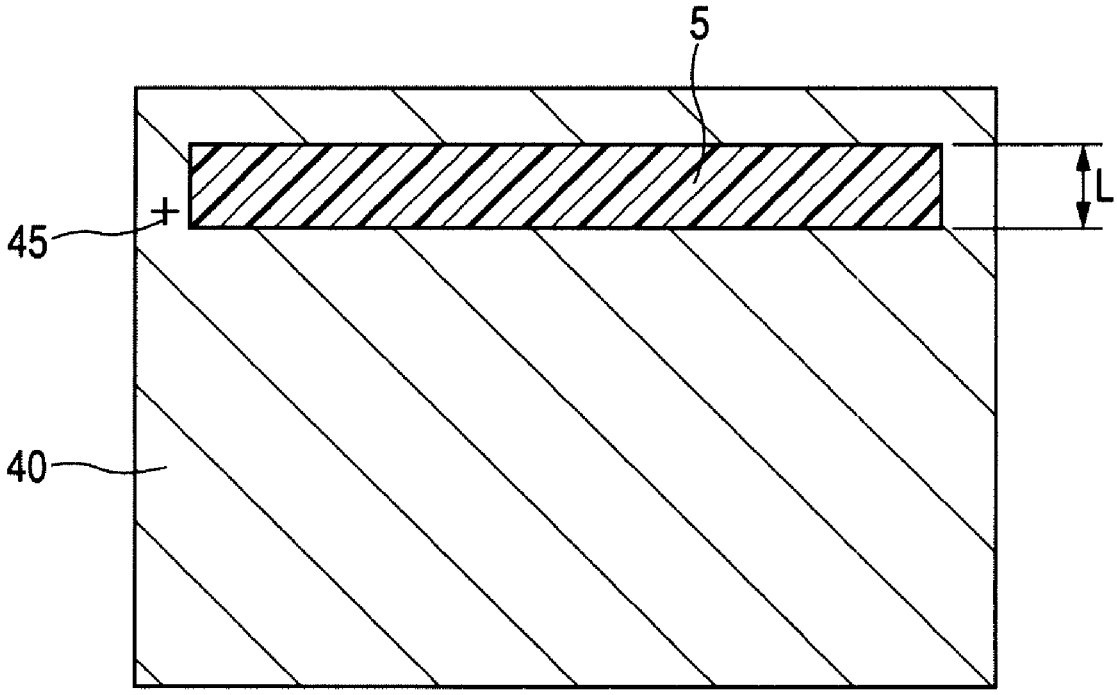
FIG. 8A is a plan view illustrating one process of the process of manufacturing the thermal head according to the embodiment.
Figure 8B:
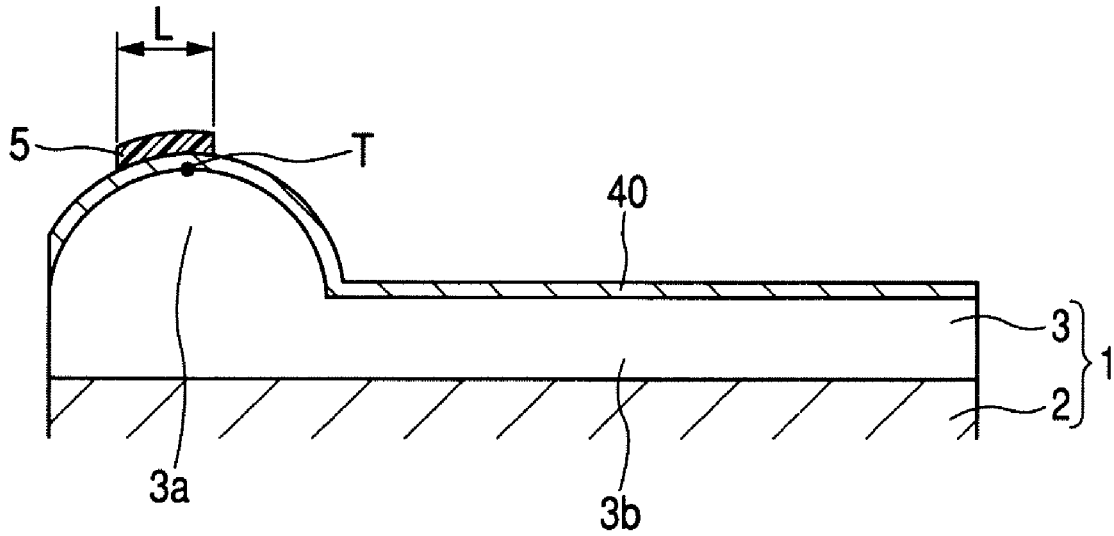
FIG. 8B is a cross-sectional view illustrating one process in the process of manufacturing the thermal head according to the embodiment.
Figure 9A:
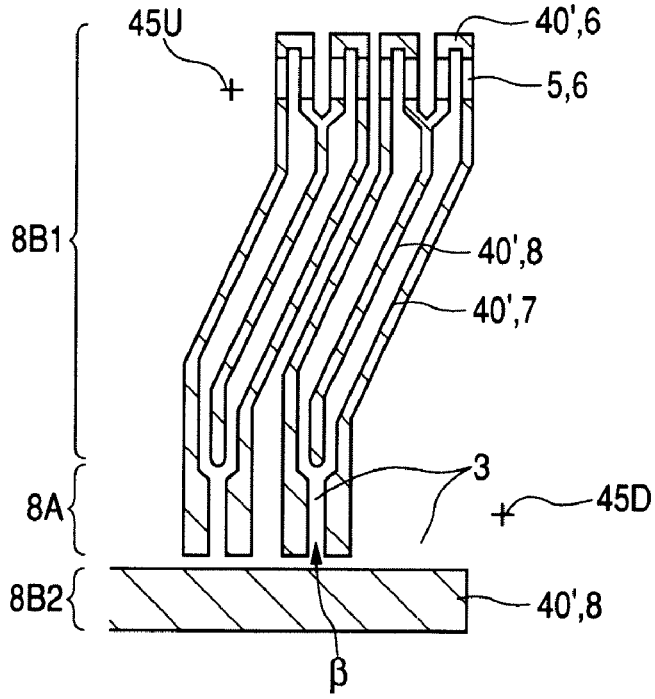
FIG. 9A is a plan view illustrating a process subsequent to the process shown in FIGS. 8A and 8B.
Figure 9B:
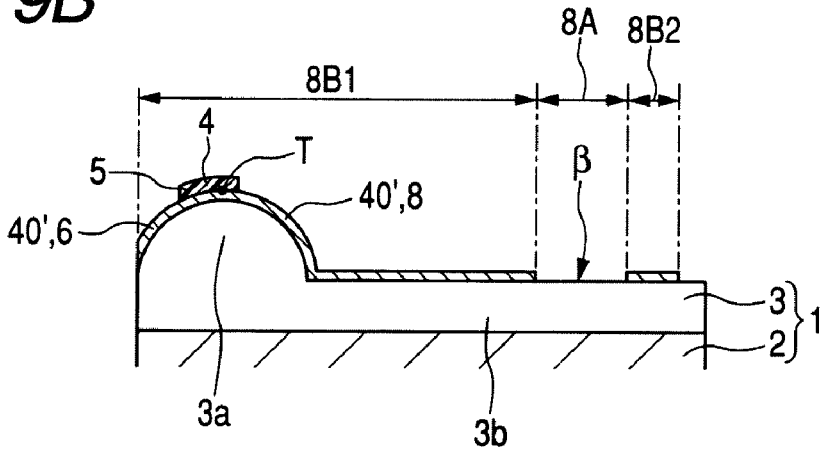
FIG. 9B is a cross-sectional view illustrating the process subsequent to the process shown in FIGS. 8A and 8B.
Figure 9C:
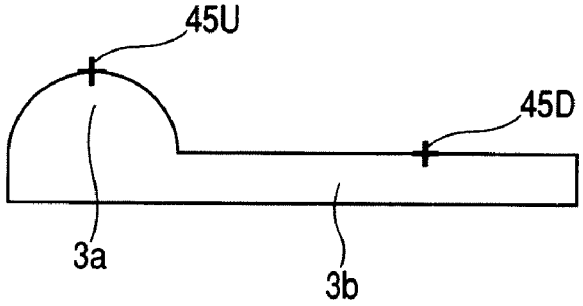
FIG. 9C is a cross-sectional view illustrating the positions of upper and lower alignment marks formed in the process.
Figure 10A:
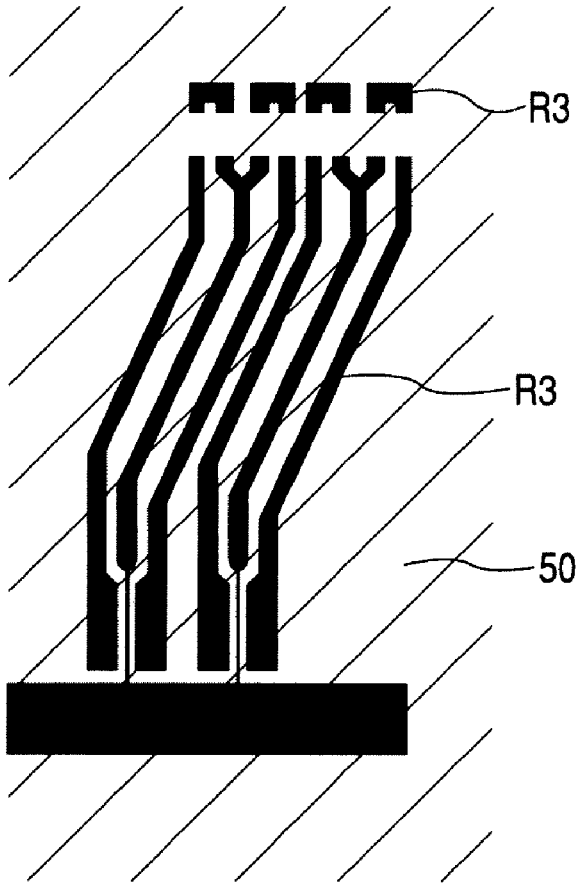
FIG. 10A is a plan view illustrating a process subsequent to the process shown in FIGS. 9A to 9C.
Figure 10B:
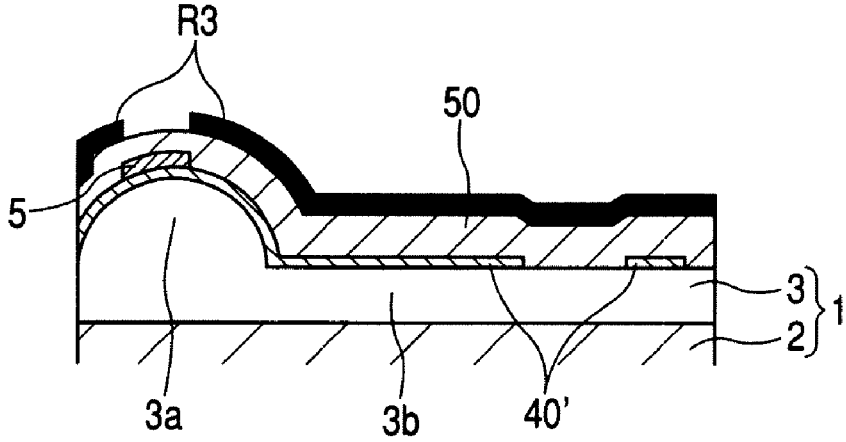
FIG. 10B is a cross-sectional view illustrating the process subsequent to the process shown in FIGS. 9A to 9C.

Next, a method of manufacturing the thermal head according to the present embodiment will be described with reference to FIGS. 5 to 10. FIGS. 5 and 6 are views schematically explaining resist exposure performed in a photolithographic process, and FIG. 7 is a flow chart illustrating the flow of a process of manufacturing the thermal head. FIGS. 8A and 8B, 9A to 9C, and 10A and 10B are views illustrating processes of manufacturing the thermal head. Here, FIGS. 8A, 9A, and 10A are plan views, and FIGS. 8B, 9B, and 10B are cross-sectional views.

In the present embodiment, there are two types of resist exposure. The first resist exposure is one-shot exposure in which the entire resist is exposed in a state where an exposure focus F·P is focused on a top portion T of the protruding level difference part 3*a* of the entire glaze layer 3, as shown in FIG. 5. The second resist exposure is a two-step exposure including separately performed steps, that is, a step in which a resist of the top portion T is exposed in a state where an exposure focus F-P1 is focused on the top portion T of the protruding level difference part 3*a* and a step in which a resist of a bottom portion B is exposed in a state where an exposure focus F-P2 is focused on the bottom portion B of the protruding level difference part 3*a*, as shown in FIG. 6. The one-shot exposure is executed in a photolithographic process when forming the insulating barrier layer 5 and the resistor pattern, and the two-step exposure is executed in the photolithographic process when forming the Al conductor layer 50.

Hereinafter, a process of manufacturing the thermal head will be described with reference to the flow chart of FIG. 7. First, the resistor layer 40 made of, for example, Ta2N or Ta—SiO2 is formed on the entire head substrate 1 having the entire glaze layer 3 (S1).

Then, an insulating material layer made of an insulating material, such as SiO2, SiON, and SiAlON, is formed on the entire resistor layer 40 (S2).

Subsequently, a resist is coated on the insulating material layer and then the insulating material layer is patterned by using interference fringes of the resist, which are generated in the top portion T of the protruding level difference part 3*a* of the entire glaze layer 3, as positioning indicators (S3). The interference fringes of the resist can be detected through image processing for a surface of the resist. In the insulating layer patterning process, the insulating material layer is etched using a first resist pattern, which is obtained by performing one-shot exposure (see FIG. 5) and development on the resist, as a mask and then the first resist pattern is removed. Thus, as shown in FIGS. 8A and 8B, the insulating barrier layer 5 that defines the resistor length L of a heating resistor to be formed and a reference alignment mark 45 indicating the top portion T of the protruding level difference part 3*a* are formed on the resistor layer 40. A region of the resistor layer 40 covered by the insulating barrier layer 5 serves as the plurality of heating resistors 4 later. The reference alignment mark 45 is formed in the shape of a cross key whose central position can be easily distinguished and is formed in a spare region not overlapping a region where heating resistors or electrode wiring lines are formed.

Then, the resistor layer 40 is patterned using the reference alignment mark 45 (S5). In the resistor patterning process, the following steps are sequentially executed. Specifically, a step of coating a resist on the resistor layer 40 including the insulating barrier layer 5, a step of performing positional alignment of a photomask using the reference alignment mark 45 and then forming a second resist pattern by performing one-shot exposure (refer to FIG. 5) and development on the entire resist, a step of sequentially etching the insulating barrier layer 5 and the resistor layer 40 using the second resist pattern, and a step of removing the second resist pattern are sequentially executed. As a result, as shown in FIG. 9, a resistor pattern 40' that becomes a part of the common wiring line 8, the heating resistors 4, the bent wiring lines 6, and the individual wiring lines 7, an upper alignment mark 45U located on the reference alignment mark 45, and a lower alignment mark 45D indicating a bottom portion of the protruding level difference part 3*a* are formed using the resistor layer 40. In a region β that becomes the narrow wiring region 8A of the common wiring line 8, the resistor layer 40 is removed, such that the glaze layer 3 is exposed in the removed part.

In the case of performing the one-shot exposure when forming the second resist pattern, an exposure focus is not clear at the bottom portion B of the protruding level difference part 3*a*. Particularly in the narrow wiring region 8A of the common wiring line 8 where a strict condition on a line and a space is applied, a problem occurs in that a resist of a place, which is originally a gap between wiring lines, is not removed, for example. In the present embodiment, this problem is solved by removing the entire resistor layer 40 existing in the narrow wiring region 8A. The resistor pattern 40' provided directly below electrode wiring lines functions as an adhesive layer. Even if the resistor pattern 40' is not provided, a function of the electrode wiring lines is not adversely affected. Thus, the upper alignment mark 45U and the lower alignment mark 45D can be formed at the same time, such that positional deviation between both the alignment marks is suppressed to the minimum. Even though the patterning accuracy of the lower alignment mark 45D is lower than that of the upper alignment mark 45U, it is sufficient as long as the central position of the lower alignment mark 45D can be distinguished. The upper alignment mark 45U and the lower alignment mark 45D are formed in the shape of a cross key whose central position can be easily distinguished.

After the resistor patterning process, the Al conductor layer 50 is formed on the entire glaze layer 3 including the insulating barrier layer 5 and the resistor pattern 40' (S6).

Then, a resist is coated on the Al conductor layer 50 (S7) and then the two-step exposure on the resist is performed using the upper alignment mark 45U and the lower alignment mark 45D (S8 and S9: refer to FIG. 6). In the two-step exposure, the position of a photomask is first adjusted using the upper alignment mark 45U and the resist of the top portion T is exposed in a state where the exposure focus F-P1 is focused on the top portion T of the protruding level difference part 3*a* (S8). Then, the position of a photomask is adjusted using the lower alignment mark 45D and the resist of the bottom portion B is exposed in a state where the exposure focus F-P2 is focused on the bottom portion B of the protruding level difference part 3*a* (S9). After the exposure, the entire resist is developed (S10). As a result, a third resist pattern R3 shown in FIGS. 10A and 10B is formed on the Al conductor layer 50. The third resist pattern R3 is formed in the same shape as the bent wiring lines 6, the individual wiring lines 7, and the common wiring line 8 to be formed.

Subsequently, the Al conductor layer 50 is etched using the third resist pattern R3 as a mask (S11), such that the bent wiring lines 6, the individual wiring lines 7, and the wide wiring region 8B (plurality of branch wiring line portions 8B1 and large-area wiring line portion 8B2) of the common wiring line 8 formed by using the resistor pattern 40' and the Al conductor layer 50 and the narrow wiring region 8A of the common wiring line 8 formed by using only the Al conductor layer 50 are obtained. Between the bent wiring line 6, the individual wiring lines 7, and the common wiring lines 8 (plurality of branch wiring line portions 8B1), openings are provided at distances, which are slightly smaller than the resistor length L of the heating resistor 4, there between. Through the openings, the insulating barrier layer 5 is exposed. By performing the two-step exposure using the upper alignment mark 45U and the lower alignment mark 45D that are formed at the same time, the third resist pattern R3 is formed at both the top portion T and the bottom portion B of the protruding level difference part 3*a* with good pattern accuracy and the pattern deviation at the top portion T and the bottom portion B is suppressed to the minimum. As a result, the narrow wiring region 8A of the common wiring line 8 where a line and a space are narrow can also be formed with high accuracy. After the etching, the third resist pattern R3 is removed.

Thereafter, the bonding pad 9 is formed at an end of the individual wiring line 7 (S12), and then the insulating and abrasion-resistant protective layer 11 that cover the insulating barrier layer 5, the individual wiring lines 7, and the branch wiring line portions 8B1 of the common wiring line 8 is formed (step S13). Before forming an insulating material layer made of, for example, SiO2 or SiAlON, the insulating and abrasion-resistant protective layer 11 is formed by covering a bonding portion, which includes the bonding pads 9, the narrow wiring region 8A of the common wiring line 8 located between the bonding pads 9, and the large-area wiring line portion 8B2, with an adhesive resin tape and then lifting off an unnecessary part of the insulating material layer by peeling off the adhesive resin tape when forming the insulating material layer. Even though a stress concentrates on a region α shown in FIG. 4 when peeling off the adhesive resin tape, the resistor pattern 40' serving as an adhesive layer of the Al conductor layer 50 exists in the region α. Accordingly, it is possible to prevent the Al conductor layer 50 from peeling off or breaking.

After forming the insulating and abrasion-resistant protective layer 11, the individual wiring lines 7 and the driver ICs 21 of the IC substrate 20 are connected to each other by wire bonding and both ends of the large-area wiring line portion 8B2 of the common wiring line 8 in the longitudinal direction thereof and the power sources 22 of the IC substrate 20 are connected to each other (S14). Then, the bonding portion including the bonding pads 9, the narrow wiring region 8A of the common wiring line 8 located between the bonding pads 9, and the large-area wiring line portion 8B2 are sealed with the sealing resin 12 (S15). In the narrow wiring region 8A of the common wiring line 8, the adhesion between the Al conductor layer 50 and the glaze layer 3 is weak because the resist pattern 40' does not exist directly below the Al conductor layer 50. However, since the narrow wiring region 8A of the common wiring line 8 is completely sealed with the sealing resin 12, the Al conductor layer 50 does not peel off or does not break due to an external force.

By the processes described above, the thermal head according to the embodiment of the invention is completed.

As described above, in the present embodiment, the narrow wiring region 8A of the common wiring line 8 is formed by using only the Al conductor layer 50. In other words, when patterning the resistor layer 40, the resistor layer 40 is removed in the narrow wiring region 8A of the common wiring line 8 where a line and a space are very narrow. Accordingly, a problem in which an unnecessary resist remains even if the second resist pattern is formed by one-shot exposure does not occur, and it is possible to form the upper alignment mark 45U and the lower alignment mark 45D with small positional deviation at the top portion T and the bottom portion B of the protruding level difference part 3*a*. In addition, in the case of using the upper alignment mark 45U and the lower alignment mark 45D, the electrode wiring lines (bent wiring lines 6, individual wiring lines 7, and common wiring line 8) obtained by forming the third resist pattern using the two-step exposure and etching the Al conductor layer 50 using the third resist pattern as a mask have good pattern accuracy at both the top portion T and the bottom portion B of the protruding level difference part 3*a* and the pattern deviation at the top portion T and the bottom portion B is also suppressed to the minimum. Accordingly, the narrow wiring region 8A of the common wiring line 8 where the line and the space are very narrow is also formed with high accuracy and it is prevented that wiring lines are short-circuited.

Furthermore, in the present embodiment, the bent wiring lines 6, the individual wiring lines 7, and the wide wiring region 8B of the common wiring line 8 are formed using the resistor pattern 40' (resistor layer 40) and the Al conductor layer 50, and accordingly, the adhesion of the Al conductor layer 50 in the electrode wiring lines is good. As a result, even if the insulating and abrasion-resistant protective layer 11 is damaged to be exposed, it is possible to prevent the Al conductor layer 50 from peeling off or breaking.

In the present embodiment, the bent wiring lines 6, the individual wiring lines 7, and a part of the common wiring line 8 are formed using the Al conductor layer 50. However, the material is not limited to Al. For example, high-melting-point metal materials such as Cr, Ta, Mo, W, and Ti, alloy materials containing the high-melting-point metal materials, an alloy material containing Al, Cu, and an alloy material containing Cu may be used to form the bent wiring lines 6, the individual wiring lines 7, and a part of the common wiring line 8.

In addition, although the reference alignment mark 45, the upper alignment mark 45U, and the lower alignment mark 45D are formed in the shape of the cross key, the reference alignment mark 45, the upper alignment mark 45U, and the lower alignment mark 45D may be formed in the shape whose central position can be easily distinguished without being limited to the cross key shape.

In addition, the narrow wiring region 8A of the common wiring line 8 located between the bonding pads 9 arranged in a line has been explained as a narrow wiring region where the width of an electrode wiring line is small. However, the invention may be effectively applied to a wiring region where the width of a line and the width of a space are equal to or smaller than 6 μm as well as the narrow wiring region 8A.

The invention claimed is:

1. A thermal head comprising:

a glazed substrate having a protruding level difference part;

a plurality of heating resistors arranged in a line at predetermined pitches there between on the protruding level difference part; and electrode wiring lines used to cause the plurality of heating resistors to electrically conduct, wherein each of the electrode wiring lines has a wide wiring region and a narrow wiring region, the wide wiring region is formed using a conductor layer and a resistor layer made of the same material as the heating resistors, and the narrow wiring region is formed using only the conductor layer without the resistor layer.

2. The thermal head according to claim 1, wherein an insulating barrier layer comprised of an insulating material is disposed on surfaces of the plurality of heating resistors.

3. A thermal head comprising:

a glazed substrate having a protruding level difference part;

a plurality of heating resistors arranged in a line at predetermined pitches there between on the protruding level difference part;

bent wiring lines each of which serves to electrically connect a pair of adjacent heating resistors to each other;

a common wiring line and individual wiring lines used to cause the pair of adjacent heating resistors to electrically conduct through each of the bent wiring lines; and bonding pads used for connection of a driver IC, the bonding pads being formed on one ends of the individual wiring lines, wherein the common wiring line has a narrow wiring region located between the bonding pads arranged in a line and a wide wiring region wider than the narrow wiring region, the wide wiring region is formed using a conductor layer and a resistor layer made of the same material as the heating resistors, and the narrow wiring region is formed using only the conductor layer without the resistor layer.

4. The thermal head according to claim 3, wherein a sealing resin layer is provided, the sealing layer covering a bonding portion, which includes at least the narrow wiring region of the common wiring line, the bonding pads, and driver ICs wire-bonded to the bonding pads.

* * * * *